US007988822B2

(12) United States Patent
Stromberg

(10) Patent No.: US 7,988,822 B2
(45) Date of Patent: Aug. 2, 2011

(54) TREATMENT VESSEL FOR STRAW OR OTHER LIGHT BULKY MATERIAL

(75) Inventor: C. Bertil Stromberg, Diamond Point, NY (US)

(73) Assignee: Andritz Inc., Glens Falls, NY (US)

( * ) Notice: Subject to any disclaimer, the term of this patent is extended or adjusted under 35 U.S.C. 154(b) by 367 days.

(21) Appl. No.: 12/206,365

(22) Filed: Sep. 8, 2008

(65) Prior Publication Data

US 2009/0095430 A1 Apr. 16, 2009

Related U.S. Application Data

(60) Provisional application No. 60/978,913, filed on Oct. 10, 2007.

(51) Int. Cl.
*D21C 5/00* (2006.01)
*D21C 7/00* (2006.01)

(52) U.S. Cl. ..... 162/99; 162/94; 162/96; 162/97; 162/98; 162/243

(58) Field of Classification Search ..... 162/94–99
See application file for complete search history.

(56) References Cited

U.S. PATENT DOCUMENTS

| | | | | |
|---|---|---|---|---|
| 4,028,171 | A * | 6/1977 | Richter | 162/19 |
| 5,985,096 | A * | 11/1999 | Marcoccia et al. | 162/39 |
| 6,280,569 | B1 | 8/2001 | Sheerer | |
| 2003/0205343 | A1 | 11/2003 | Salminen | |

OTHER PUBLICATIONS

European Search Report for EP Application No. 08017207 (Jan. 28, 2009).

* cited by examiner

*Primary Examiner* — Matthew J Daniels
*Assistant Examiner* — Anthony J Calandra
(74) *Attorney, Agent, or Firm* — Nixon & Vanderhye P.C.

(57) ABSTRACT

A method to chemically treat light weight, bulky cellulosic material including: introducing the material to an upper inlet of a substantially vertical treatment vessel; maintaining the material in the vessel at a pressure of at least 20 bar and at a temperature of at least 200° C.; treating the material with a cooking liquor in the vessel; moving the material past at least one anti-compression ring on an inside surface of the vessel, as the material moves downward through the vessel; agitating the material in the vessel, and discharging the treated material from a lower discharge port of the vessel.

10 Claims, 3 Drawing Sheets

TREATMENT VESSEL FOR STRAW OR OTHER LIGHT BULKY MATERIAL

BACKGROUND

This application claims the benefit of U.S. Provisional Patent Application 60/978,913, filed Oct. 10, 2007, the entirety of which is incorporated by reference.

BACKGROUND

The invention relates to the processing of light weight, bulky cellulosic material, such as straw and other non-wood cellulosic material, to pulp. The invention particularly relates to chemical processing of such material.

Straw and other light weight, bulky cellulosic material are converted to pulp for use in paper, building materials and other pulp based products. These materials are processed by chemical and mechanical processing treatments. The chemical treatment of these materials typically involves caustic chemicals and short processing times.

Chemical treatment vessels that treat straw and other light weight, bulky cellulosic materials accommodate the severe chemical conditions and short retention times involved in the chemical processing, e.g., hydrolysis, of these materials. A conventional chemical treatment vessel includes a series of horizontal tubes arranged side-by-side and is referred to as a Pandia digester. Conduits connect the tubes and provide a flow path for material flowing from the discharge of one tube to the inlet to the next tube. The arrangement of tubes requires a relatively complex mechanical assembly to support the Pandia digester. Material undergoing treatment flows from one tube to the next.

In the tubes, the material is maintained at temperatures of 200° C. and pressures of 20 bar (about 290 pounds per square inch (psi)) with retention times of less than 30 minutes. Screws internal to each tube move the material through each tube. The screws are prone to becoming clogged with the material and require maintenance.

The multiple tubes make the Pandia digester a mechanically complex device having a large number of moving components, e.g., screws. There is a long felt need for treatment vessels having few moving components, at least as compared to the multiple screw conveyors in a Pandia digester. There is also a long felt need for chemical treatment vessel capable of processing large volumes of material, such as 400 tons per day with a four minute retention time in the vessel. Accordingly, there is a long felt need for a chemical treatment vessel having a relatively simple structure and capable of processing large volumes of straw and other light weight bulky cellulosic materials.

SUMMARY OF THE INVENTION

A single vessel has been developed for chemical treatment of light weight, bulky cellulosic material, such as straw and other non-wood cellulosic material. The vessel is preferably predominantly a cylinder having an interior treatment chamber with a sealed top and bottom to allow for pressures of at least 20 bar and preferably 40 bar and temperatures of at least 100° C. and preferably 200° C. The treatment chamber is substantially vertical, e.g., within 10 degrees of vertical, and may have a diameter of 1.5 to 4 meters and a height of 0.5 to 20 meters, depending on the desired volumetric flow rate and retention time of material in the chamber.

The material may be introduced through an upper inlet port to the vessel. Treatment liquids (if needed these liquids are preferably acidic chemicals to support hydrolysis, although treatments with ammonia are also suitable) and water may be added to promote treatment of the material in the chamber and to transport the material through a lower discharge. Anti-compression rings may be arranged in the upper elevations of the chamber and agitators may be included proximate to the anti-compression rings. The bottom discharge of the chamber may include devices to facilitate discharge of the material, such as one-dimensional sidewall transitions of the chamber to promote material flow, rotation devices to move material to the discharge, and baffles to allow for the injection of fluid in the bottom of the chamber that increases the fluid to material ratio as the material is discharged from the chamber or combinations thereof.

A method has been developed to chemically treat light weight, bulky cellulosic material including: introducing the material to an upper inlet of a substantially vertical treatment vessel; maintaining the material in the vessel at a pressure of at least 20 bar and at a temperature of at least 200° C.; treating the material with a cooking liquor in the vessel; moving the material past at least one anti-compression ring on an inside surface of the vessel, as the material moves downward through the vessel; agitating the material in the vessel, and discharging the treated material from a lower discharge port of the vessel.

A treatment vessel has been developed for chemically treating light weight, bulky cellulosic material, the vessel comprising: a generally vertical vessel having a sealed top and bottom and a sidewall extending from the top to the bottom, wherein the vessel is operated at a pressure of at least 20 bar and at a temperature of at least 200° C.; a material inlet port in an upper section of the vessel, wherein the inlet port receives the cellulosic material; a cooking liquor inlet port in the vessel or in a material feed system coupled to the material inlet port; at least one anti-compression ring on an inside surface of the sidewall; an agitator proximate to the anti-compression ring and agitating the material in the vessel, and a discharge outlet in a lower portion of the vessel.

SUMMARY OF THE DRAWINGS

A preferred embodiment and best mode of the invention is illustrated in the attached drawings that are described as follows.

DETAILED DESCRIPTION

Figure 1:
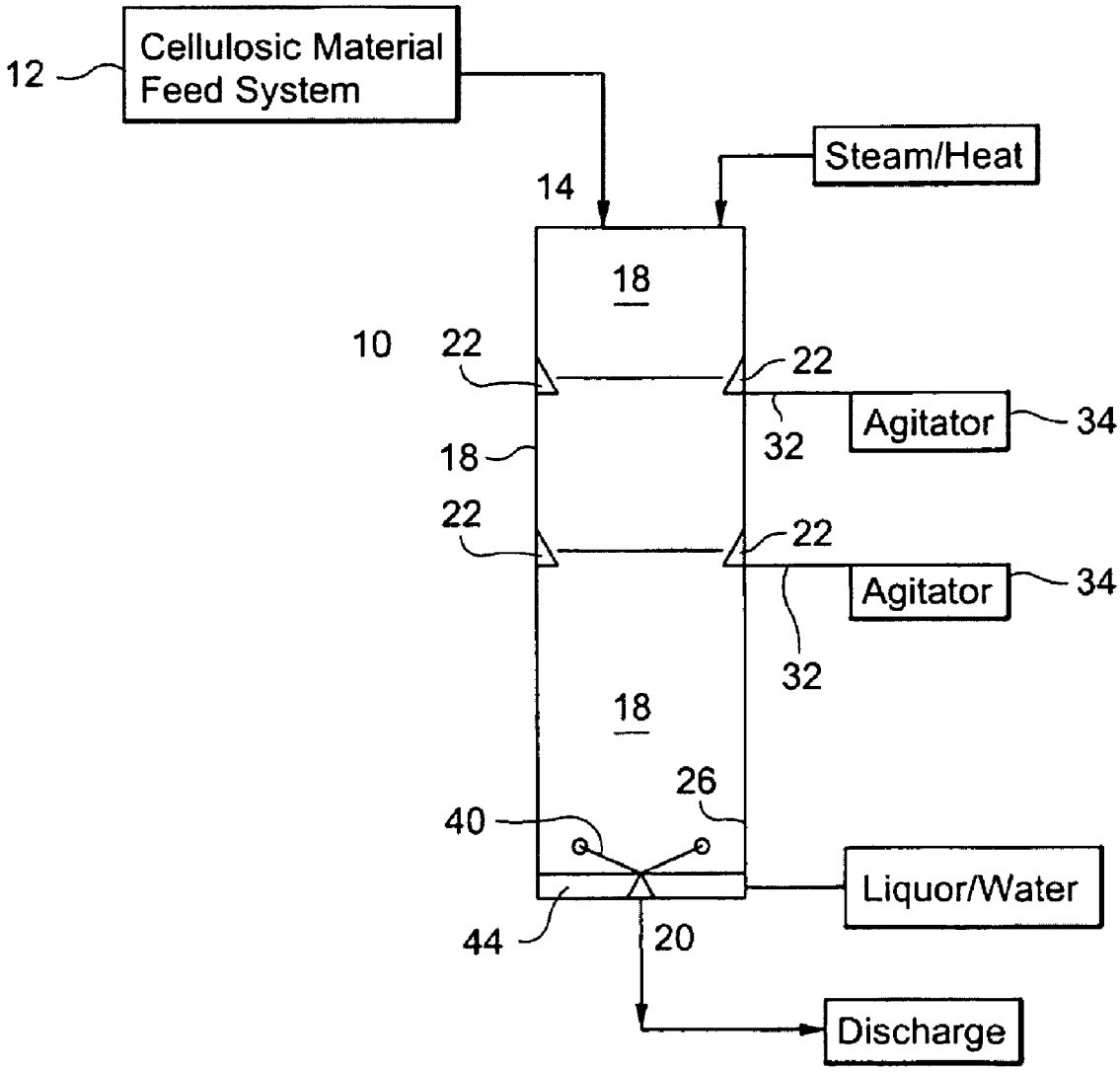
FIG. 1 is a schematic diagram of a treatment vessel for chemical treatment, e.g., digesting, of light weight, bulky cellulosic material to produce, for example, pulp.

FIG. 1 schematically illustrates a chemical treatment vessel 10 that has been developed to treat light weight, bulky cellulosic materials, such as straw ("collectively referred to as light weight cellulosic material"). By way of example, light weight cellulosic material has a density of 50 to 120 kg/m3 (kilograms per meter cubed) which is less dense than conventional wood chips. In the example disclosed herein, the vessel 10 is a vertical reactor capable of processing 400 tons per day of the light weight cellulosic material and having a volumetric capacity of 14 cubic meters. The vessel 10 may be a closed vessel having a cylindrical body having a constant diameter circular cross-section and the body has sealed upper and lower ends.

In one embodiment, the cylindrical vessel 10 has a diameter of 1.5 meters and a height of 8 meters. In other embodiments, the vessel may have a diameter in a range of 1 meter to 10 meters, or a narrower range of 3 to 4 meters. The height of the vessel may be in a range of 0.5 meters to 40 meters. The diameter and height of the vessel may be selected depending on the desired volumetric rate of material to flow through the vessel and the retention time of material in the vessel.

The shape of the vessel may differ from the exemplary cylindrical vessel embodiment disclosed herein. The vessel may have a non-circular cross-sectional shape and dimensions different that are not constant, such as a conical body, a rectangular or elliptical body, and a body that has a shape more complex than a simple cylindrical, rectangular or elliptical (in cross-section) shape. A preferred characteristic of the vessel is that it be a single vessel, in contrast to the multiple tubes of prior art treatment vessels.

The vessel should be capable of operating at least at 20 bar pressure and 200° C. of temperature, and preferably at 40 bar pressure (approximately 580 psi) and 300° C. of temperature. These temperature and pressure conditions are suitable for processing light weight cellulosic material by treatments such as hydrolysis. Any liquid to be added to the vessel, such as liquor and cooling liquid to facilitate transport of the material through the discharge of the vessel, should preferably be added as water or be acidic. Organic treatment fluids may also be used, such as acetic acid, formic acid, ethanol and methanol. In one example, the vessel 10 may be used, for example, to treat non-wood lightweight cellulosic material, e.g., straw, by hydrolysis under acidic treatment conditions. In one embodiment, the retention time of the material in the vessel is preferably between 10 minutes and 120 minutes, where longer retention times may be more advantageous.

The operation of the vessel 10 may include conventional devices for controlling the flow of cellulosic material in a chemical treatment vessel, such as material level control. The control system may monitor a solids level in the vessel using, for example, a gamma gauge, and provide a feedback signal used to control the rate of material entering the vessel from the material feed system 12 and the discharge rate of pulp from the bottom discharge 20. In addition, force sensors, e.g., strain gauges, may be included in the vessel to monitor pressures and forces in the vessel. Further, sensors may monitor the rotating speed of moving components in the system, such as a screw conveyor in the feed system 12 and the movement of the agitators.

The retention time and temperature of the cellulosic material in the vessel is preferably controlled and maintained at uniform levels. Control of the retention time and temperature assists in achieving the desired yield of products from the chemical reactions of the material and liquor in the vessel. Further, control of the retention time and temperature is needed to avoid side reactions in the vessel that may result in the loss of the desired reactions products.

The vessel 10 includes a feed system 12 for the light weight cellulosic material. The feed system may be a conventional system, such as a chip bin, chip screw conveyor with inlets for steam and liquor to facilitate transport of the material to and through the vessel. The vessel has an inlet port 14 at a top or upper section of the vessel. The feed system 12 may be used to transport the cellulosic material from a chip bin operating at atmospheric pressure to the vessel inlet 14 which is at a pressurized conditions, such as a temperature of 200° C. and a pressure of 20 bar, at which the vessel operates.

The vessel 10 is a pressurized vessel that is capable of maintaining uniform flow of the cellulosic material through the vessel. Preferably, the amount of liquor, e.g., liquids with chemicals to digest the cellulosic material to pulp, introduced to vessel is minimized to efficiently heat and maintain the temperature of the material being treated in the vessel. Heat energy 16 may be added to the vessel, such as steam, hot gases or other such hot medium.

The vessel 10 may have an inside chamber 18 having a vertical sidewall in which material flows downward to a material discharge 20 at a bottom of the vessel. Within the chamber at various locations along the sidewall, anti-compression rings 22 or other suitable rings to reduce compression of the material in the vessel. These rings facilitate movement of the cellulosic material through the vessel. The rings are arranged at various elevations in the chamber, and preferably at upper elevations of the chamber such in the upper half of the chamber.

Figure 2:
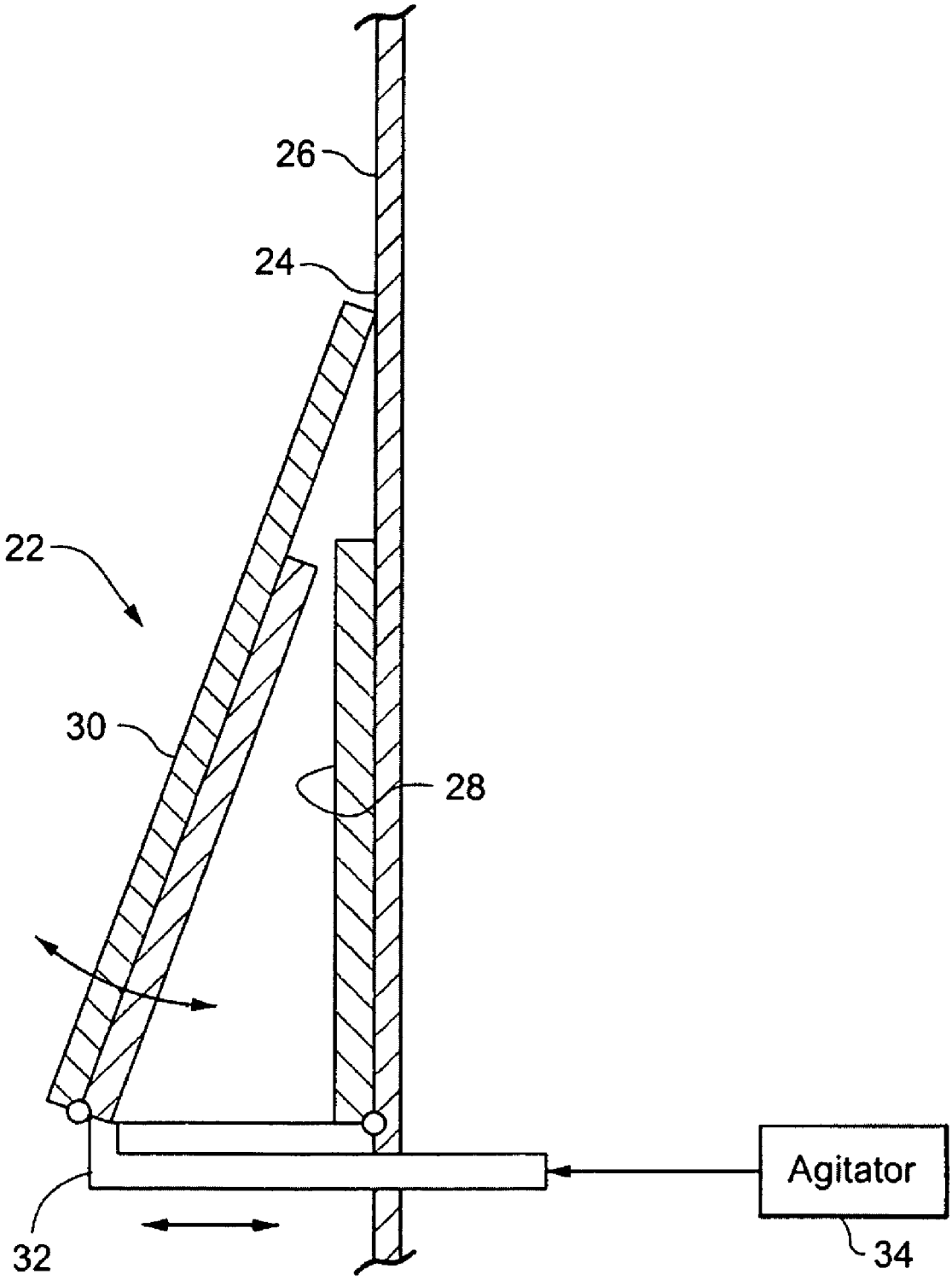
FIG. 2 is a cross-sectional diagram of an exemplary anti-compression ring for the vessel shown in FIG. 1.

FIG. 2 shows an exemplary anti-compression ring 22 which may be an annular ring having a generally right-sided triangular cross-sectional shape. The top 24 of the ring is attached to the inside wall 26 of the vessel and a first vertical cylindrical leg 28 attached to the inside wall 26. The anti-compression ring may includes a sloped side wall 30 that is inclined inward to the vessel. The anti-compression ring promotes uniform compression of the flow of material throughout the height of the vessel. The rings apply a slight compression of the material moving downward along the sloped sidewall 30 of the rings. The compression applied by the rings provides support for the material in the upper elevations of the vessel and reduces the force applied to material in the lower elevations due to material in the upper elevations. As the material flows past the ring, there is a quick release of the compression force as the material flows past the bottom edge of the sidewall 30 and expands to the larger diameter of the vessel inside wall 26. Suitable anti-compression rings are described in U.S. Pat. Nos. 6,280,569 and 5,454,490.

Agitators 32 may be included in the chamber 18 to assist the movement of material through the vessel and, particularly, past the anti-compression rings. The agitators may be positioned near and, possibly, connected to the anti-compression rings 22. The agitator 32 may be bar or shaft connected to a surface of the vessel, e.g., sloped sidewall 30, that applies an agitation movement, e.g., shaking, reciprocal movement and vibration. The agitation movement is applied to the cellulosic material to promote movement of the material through the vessel.

A motive force 34 is applied to agitator to impart the agitation movement. The agitator may be a conventional agitation device used to assist in the movement of the cellulosic material through a vessel. Combining the anti-compression rings and the agitators, such as applying a shaking arm(s) to the sloped sidewall 30, may reduce the components and especially moving components in the vessel. Further, combining the agitator and anti-compression ring reduces the mechanical components in contact with the material and thus reduces the components that might disrupt the flow of material through the vessel.

Figure 3:
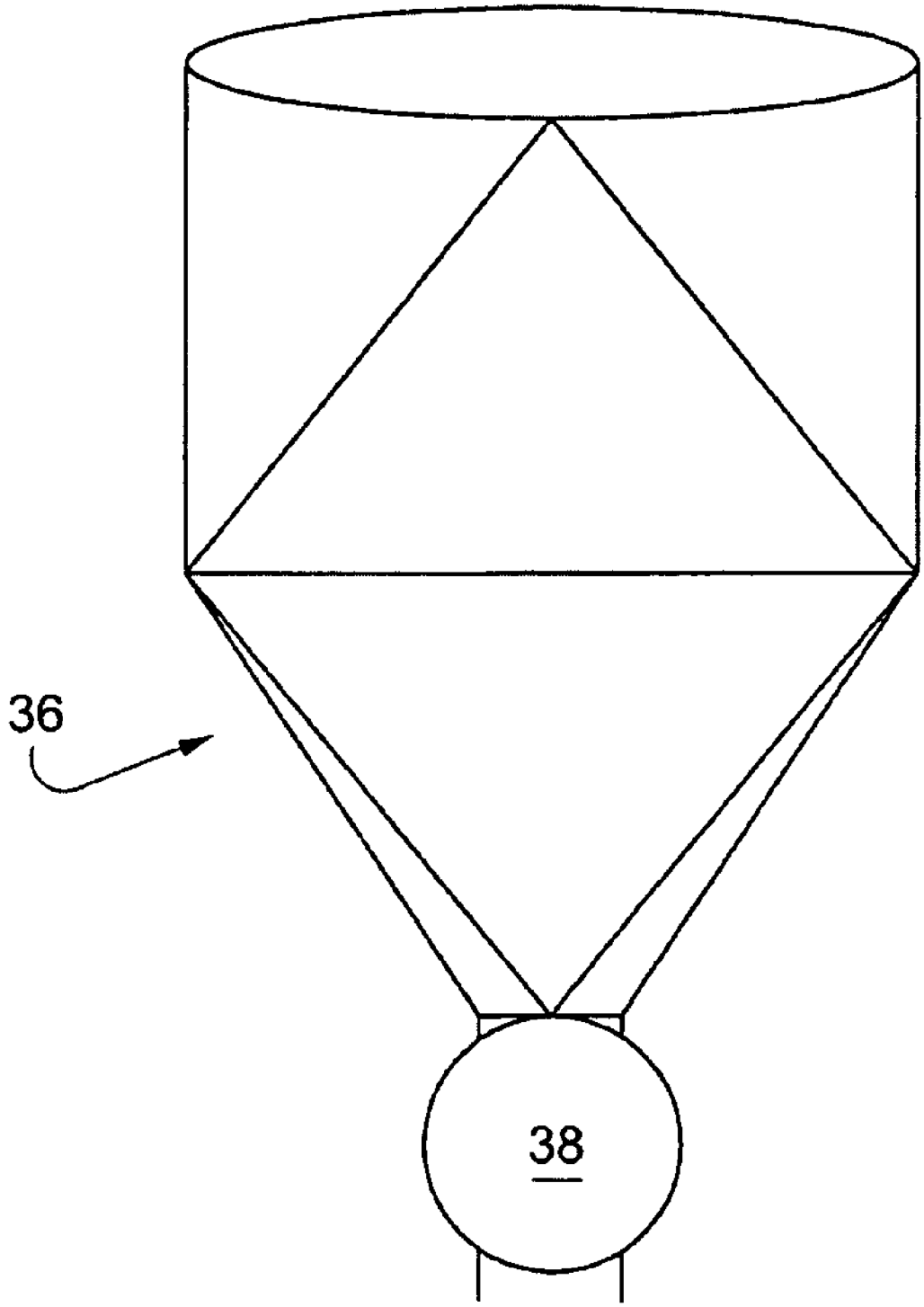
FIG. 3 is a side view of a discharge section of the vessel shown in FIG. 1.

FIG. 3 shows an exemplary discharge device 36 formed in a lower portion of the vessel in which the sidewall transitions from a cylindrical wall to a wall having a one dimensional convergence and side relief, such that a diamond shaped indention is formed on opposite sides of the discharge device. The discharge device 36 may comprise horizontal feed screws 38 mounted adjacent the bottom of the discharge device. A discharge device 36 in a bottom section of the vessel may be a flow promotion device such as described in U.S. Pat. Nos. 5,500,083; 5,628,873; and 5,617,975.

As an alternative to a horizontal feed screw, a rotating scraper 40 (that may be of conventional design) may be arranged in a lower section of the vessel. The scraper may push the cellulosic material to a central discharge point 42 at the bottom on the vessel.

A baffle 44 may be arranged at lower portion of the vessel which is just upstream of the discharge point 42. The baffle sweeps material into the discharge point. Further, a dilution liquid may be introduced through conduit 44 to the baffle area. The dilution liquid flows from the baffle area to the material moving towards the discharge point. The dilution liquid increases the liquid to material ratio so as to assist in the movement of material to the discharge point.

The invention has been described in connection with the best mode now known to the applicant inventors. The invention is not to be limited to the disclosed embodiment. Rather, the invention covers all of various modifications and equivalent arrangements included within the spirit and scope of the appended claims.

I claim:

1. A method to chemically treat light weight, bulky cellulosic material comprising:

introducing the material to an upper inlet of a substantially vertical treatment vessel;

moving the material past at least one anti-compression ring on an inside surface of the vessel, as the material moves downward through the vessel;

agitating the material in the vessel via the anti-compression ring, and discharging the treated material from a lower discharge port of the vessel.

2. The method of claim 1 further comprising maintaining the material in the vessel at a pressure of at least 20 bar and at a temperature of at least 140° C.

3. The method of claim 1 further comprising treating the material with a cooking liquor in the vessel.

4. The method of claim 1 further comprising allowing auto-hydrolysis to occur in the material in the vessel.

5. The method of claim 1 wherein the light weight, bulky cellulosic material includes at least one of straw, bagasse, corn stover, and energy crops.

6. The method of claim 1 wherein the vessel is maintained at a pressure of at least 20 bar and at a temperature of at least 200° C.

7. The method of claim 1 wherein the vessel is a single chamber vessel for chemically digesting the material to pulp.

8. The method of claim 1 wherein the anti-compression ring is in an upper portion of the vessel.

9. The method of claim 1 wherein further comprising retaining the material in the vessel for a period no greater than 30 minutes.

10. The method of claim 1 wherein the treatment includes hydrolysis of the material.

* * * * *